US010390644B1

(12) United States Patent
Lachinian et al.

(10) Patent No.: US 10,390,644 B1
(45) Date of Patent: Aug. 27, 2019

(54) ACCORDION SLEEVE FOR A BEVERAGE CONTAINER

(71) Applicants: Grisha Lachinian, Simi Valley, CA (US); Isabel Lachin, Camarillo, CA (US)

(72) Inventors: Grisha Lachinian, Simi Valley, CA (US); Isabel Lachin, Camarillo, CA (US)

(73) Assignee: Grisha Lachinian, Simi Valley, CA (US)

( * ) Notice: Subject to any disclaimer, the term of this patent is extended or adjusted under 35 U.S.C. 154(b) by 0 days.

(21) Appl. No.: 15/440,745

(22) Filed: Feb. 23, 2017

Related U.S. Application Data

(60) Provisional application No. 62/298,610, filed on Feb. 23, 2016.

(51) Int. Cl.
*A47G 23/02* (2006.01)
*B65D 81/38* (2006.01)

(52) U.S. Cl.
CPC ..... *A47G 23/0216* (2013.01); *B65D 81/3876* (2013.01); *A47G 2023/0291* (2013.01)

(58) Field of Classification Search
CPC ..... B65D 81/3865; B65D 81/3876; B65D 1/0292; B65D 21/08; B65D 21/086; B65D 23/08; B65D 23/0892; B65D 23/106; B65D 25/16; A47G 23/0216; A47G 21/001; A47G 2023/0291
USPC ..... 220/277, 278, 666, 720, 737–739, 741, 220/758; 215/382, 396, 900; 221/65, 221/310; 229/4.5, 101, 117.01, 403; 224/251; D9/455, 517, 739
See application file for complete search history.

(56) References Cited

U.S. PATENT DOCUMENTS 3,353,700 A * 11/1967 Kalina ..... B65D 7/04 220/6
3,921,897 A * 11/1975 Noyes ..... B65D 21/08 229/117.01
3,939,888 A * 2/1976 Scarnato ..... B65D 1/0292 206/218
4,228,918 A * 10/1980 Kellogg ..... A47F 1/065 221/310
4,919,381 A * 4/1990 Buist ..... A47G 23/0216 220/738
5,029,720 A * 7/1991 Bridges ..... A47G 23/0225 220/737
5,052,649 A * 10/1991 Hunnicutt ..... A47G 23/0225 224/926

(Continued)

*Primary Examiner* — J. Gregory Pickett
*Assistant Examiner* — Brijesh V. Patel
(74) *Attorney, Agent, or Firm* — Ashkan Najafi

(57) ABSTRACT

A beverage container sleeve includes a body having an accordion configuration provided with a centrally registered longitudinal axis. The body includes an exterior surface and an interior surface oppositely position therefrom wherein the interior surface preferably includes a thermally insulative layer. The body further includes an upper portion, a bellowed portion, and a lower portion. Advantageously, the bellowed portion interconnects the upper portion to the lower portion. In this manner, the bellowed portion is configured to be selectively compressed and decompressed between folded and unfolded position such that, when the bellowed portion is compressed to the folded position, the bellowed portion is outwardly displaced away from the centrally registered longitudinal axis and thereby has a greater latitudinal width and a shortened longitudinal length.

5 Claims, 10 Drawing Sheets

(56) References Cited

U.S. PATENT DOCUMENTS 5,655,742 A * 8/1997 Whitman ..... B60N 3/103 224/926
5,975,411 A * 11/1999 Windolph, III ..... B65D 5/0005 229/101
5,979,695 A * 11/1999 Valls ..... B65D 85/78 220/666
6,702,143 B2 * 3/2004 Wang ..... B65D 1/32 206/218
7,458,480 B2 * 12/2008 Nguyen ..... B65D 21/08 220/359.1
7,866,500 B1 * 1/2011 Peggs ..... B65D 21/0228 220/4.26
8,286,824 B2 * 10/2012 Ikeda ..... B65D 81/3876 220/739
2009/0114657 A1 * 5/2009 Hsu ..... A47G 19/02 220/574
2009/0114661 A1 * 5/2009 Lim ..... A47G 23/0216 220/737
2011/0248037 A1 * 10/2011 Fung ..... B65D 21/0219 220/592.2
2011/0284547 A1 * 11/2011 McElligott ..... B65D 21/086 220/495.03
2012/0325836 A1 * 12/2012 Nenniger ..... A47G 23/0216 220/720
2013/0153728 A1 * 6/2013 Porcelli ..... B60N 3/102 248/311.2
2013/0206782 A1 * 8/2013 Lee ..... B60N 3/101 220/737
2013/0277364 A1 * 10/2013 Kusuma ..... A45F 3/20 220/8
2014/0103036 A1 * 4/2014 Perlman ..... A45F 3/20 220/8
2015/0291201 A1 * 10/2015 Hartenstine ..... B62B 7/10 280/47.38

* cited by examiner

ACCORDION SLEEVE FOR A BEVERAGE CONTAINER

CROSS REFERENCE TO RELATED APPLICATIONS

This is a non-provisional patent application that claims the benefit of U.S. provisional patent application No. 62/298,610 filed Feb. 23, 2016, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to beverage container sleeves and, more particularly, to an accordion sleeve configured to be removably position about a beverage container such that the accordion sleeve is selectively extended and retracted between elongated and shortened states.

Prior Art

While traveling, individuals often transport hot or cold beverages that they wish to insulate. Because the beverages may be extremely hot or cold, individuals often carry or transport the cups holding these beverages with an insulating sleeve. These beverages and their sleeves are either carried and held in hand or inserted into vehicle cup holders, when driving. Though, these methods are typically effective at transporting beverages, they are not full proof in that inserting a beverage inside of a vehicle cup holder may leave the beverage loosely gripped and put the beverage at risk of toppling over and spilling its contents. This can be particularly unsafe when driving as dropping a hot beverage in a vehicle can cause serious injury to a driver or passenger and may cause and accident. Thus, there is a need for an insulating cup sleeve comprising an adjustable portion configured to adjust in size, thereby enabling users to store their smaller beverages in larger cup holders without the worry of the beverages toppling over and spilling.

Accordingly, a need remains for beverage container sleeves in order to overcome at least one aforementioned shortcoming. The exemplary embodiment(s) satisfy such a need by providing an accordion sleeve configured to be removably position about a beverage container that is convenient and easy to use, lightweight yet durable in design, versatile in its applications, and designed for being selectively extended and retracted between elongated and shortened states.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide an accordion sleeve configured to be removably position about a beverage container such that the accordion sleeve is selectively extended and retracted between elongated and shortened states. These and other objects, features, and advantages of the non-limiting exemplary embodiment(s) are provided by a beverage container sleeve for maintaining an existing beverage container at a substantially stable position within an existing cup holder. Such a beverage container sleeve includes a body having an accordion configuration provided with a centrally registered longitudinal axis. The body includes an exterior surface and an interior surface oppositely position therefrom wherein the interior surface preferably includes a thermally insulative layer. The body further includes an upper portion, a bellowed portion, and a lower portion. Advantageously, the bellowed portion interconnects the upper portion to the lower portion. In this manner, the bellowed portion is configured to be selectively compressed and decompressed between folded and unfolded position such that, when the bellowed portion is compressed to the folded position, the bellowed portion is outwardly displaced away from the centrally registered longitudinal axis and thereby has a greater latitudinal width and a shortened longitudinal length. Such a structural configuration facilitates frictional contact with an oversized cup holder such that the beverage container does not fall downward and through the oversized cup holder.

In a non-limiting exemplary embodiment, each of the upper portion and the lower portion is open and has a static diameter.

In a non-limiting exemplary embodiment, the bellowed portion is intercalated between the upper portion and the lower portion. Advantageously, the bellowed portion is flexible and configured to be selectively reciprocate between an elongated position and a shortened position.

In a non-limiting exemplary embodiment, a longitudinal length of the bellowed portion is greater at the elongated position than the shortened position.

In a non-limiting exemplary embodiment, the bellowed portion includes a plurality of flexible sections configured to be biased between a folded state and an unfolded state along a direction substantially parallel to the centrally registered longitudinal axis.

In a non-limiting exemplary embodiment, the bellowed portion further includes a plurality of perforated cut-outs extended along a height of each the flexible sections. Such perforated cut-outs are juxtaposed along a circumferential length of the flexible sections. Advantageously, each of the perforated cut-outs is prohibited from traversing between adjacently positioned ones of the perforated cut-outs.

In a non-limiting exemplary embodiment, a bottom-most one of the flexible sections has a diameter smaller than a diameter of a top-most one of the flexible sections.

In a non-limiting exemplary embodiment, the flexible sections are contiguously connected in a stacked configuration.

The present disclosure further includes a method of utilizing a beverage container sleeve to secure an existing beverage container within an existing cup holder. Such a method includes the steps of: providing an existing cup holder; providing an existing beverage container; and providing a beverage container sleeve including a body having an accordion configuration provided with a centrally registered longitudinal axis. Such a body includes an exterior surface and an interior surface oppositely position therefrom, wherein the interior surface preferably includes a thermally insulative layer. The body further includes an upper portion, a bellowed portion, and a lower portion. Advantageously, the bellowed portion interconnects the upper portion to the lower portion.

The method further includes the steps of: slidably positioning the beverage container sleeve about the existing beverage container; selectively compressing and decompressing the bellowed portion of the beverage container sleeve between folded and unfolded positions wherein, when the bellowed portion is compressed to the folded position, the bellowed portion is outwardly displaced away from the centrally registered longitudinal axis and thereby has a greater latitudinal width and a shortened longitudinal length; and while the bellowed portion is at the folded position, contemporaneously positioning the beverage container sleeve and the existing beverage container within the existing cup holder such that the bellowed portion maintains frictional engagement with an interior surface of the existing cup holder.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
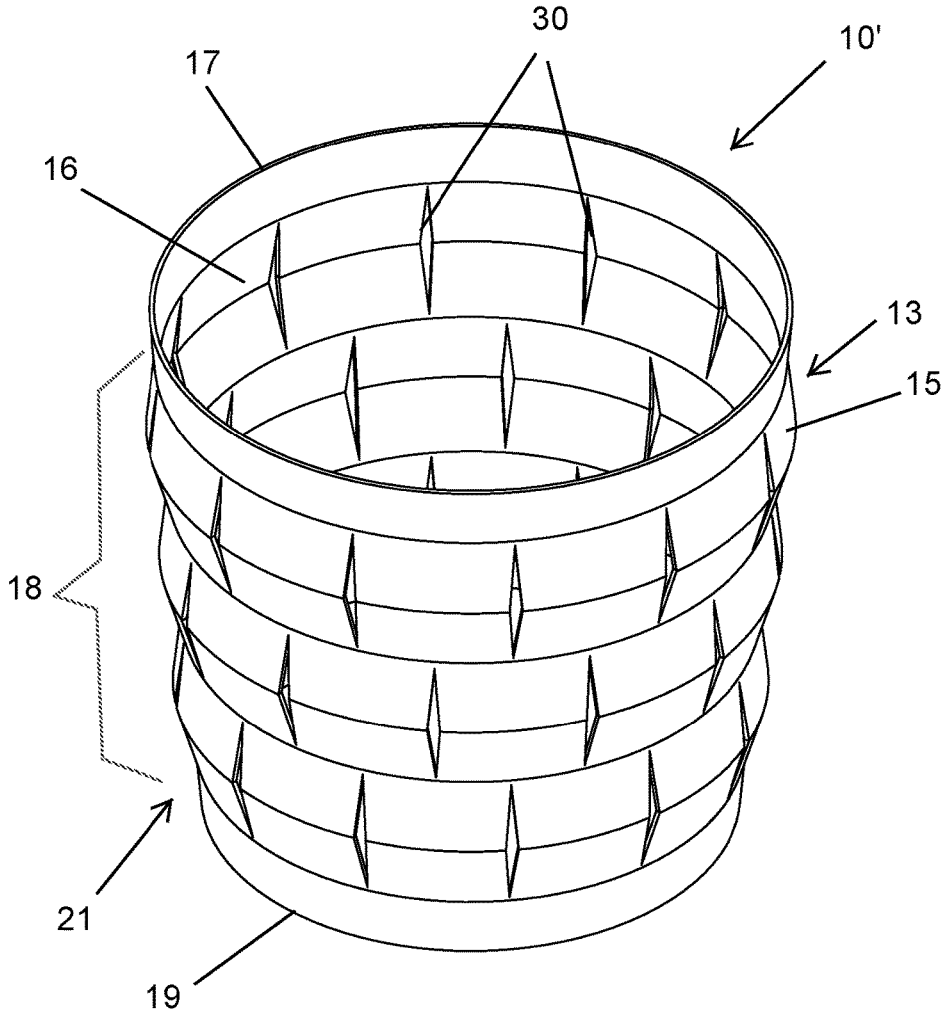
FIG. 1 is a perspective view of an insulating cup sleeve, in accordance with a non-limiting exemplary embodiment.
Figure 2:
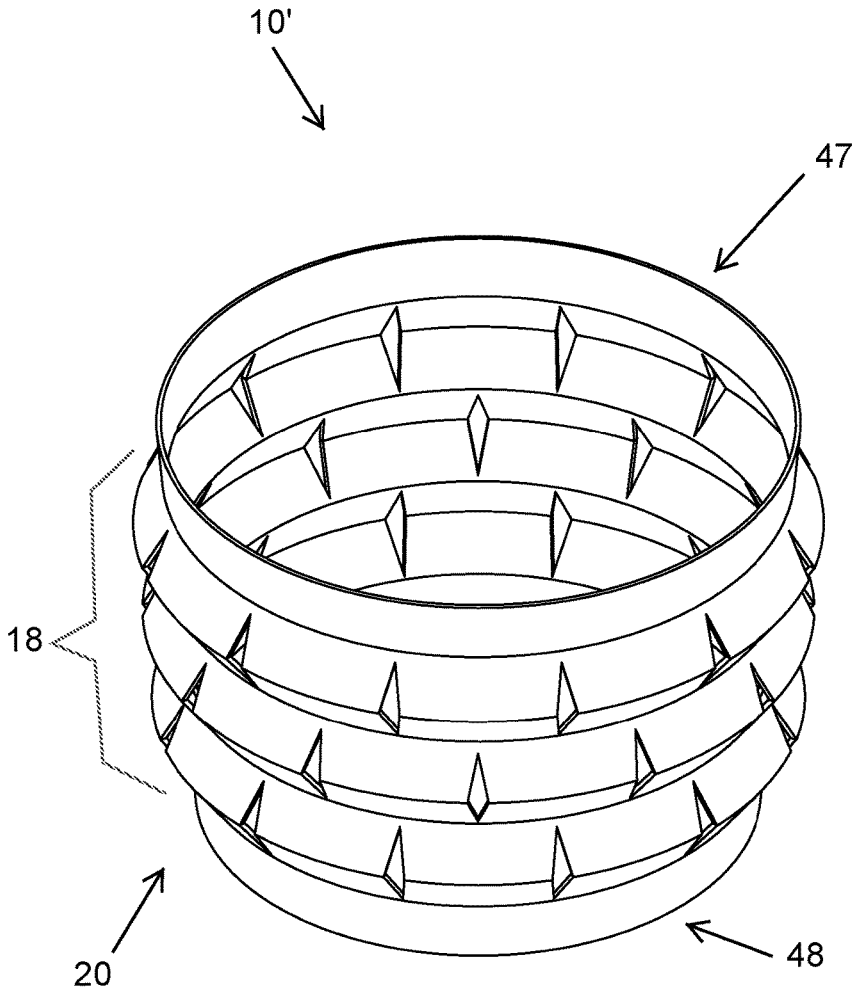
FIG. 2 is a perspective view of the insulating cup sleeve, shown in FIG. 1, compressed to a shortened state.
Figure 3:
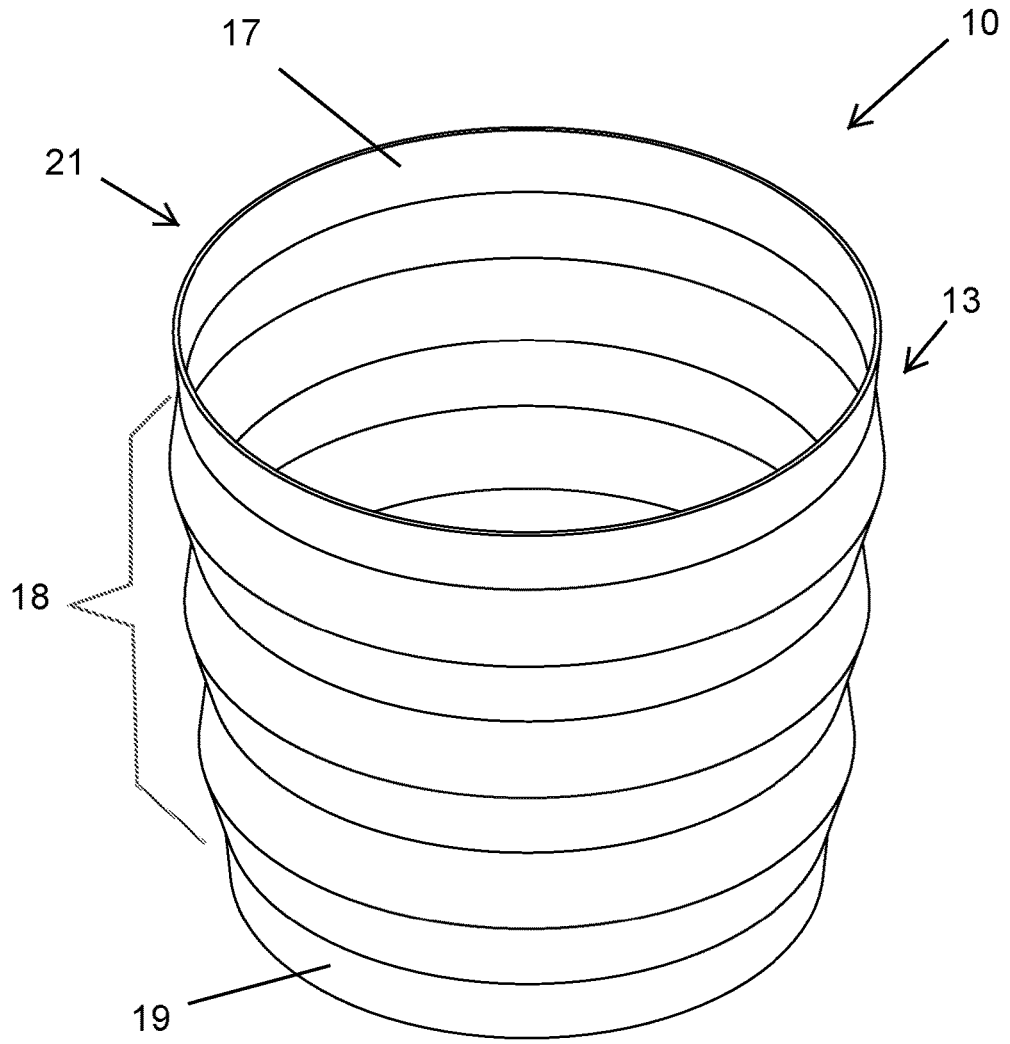
FIG. 3 is a perspective view of an insulating cup sleeve decompressed to an elongated (extended) state, in accordance with another non-limiting exemplary embodiment.
Figure 4:
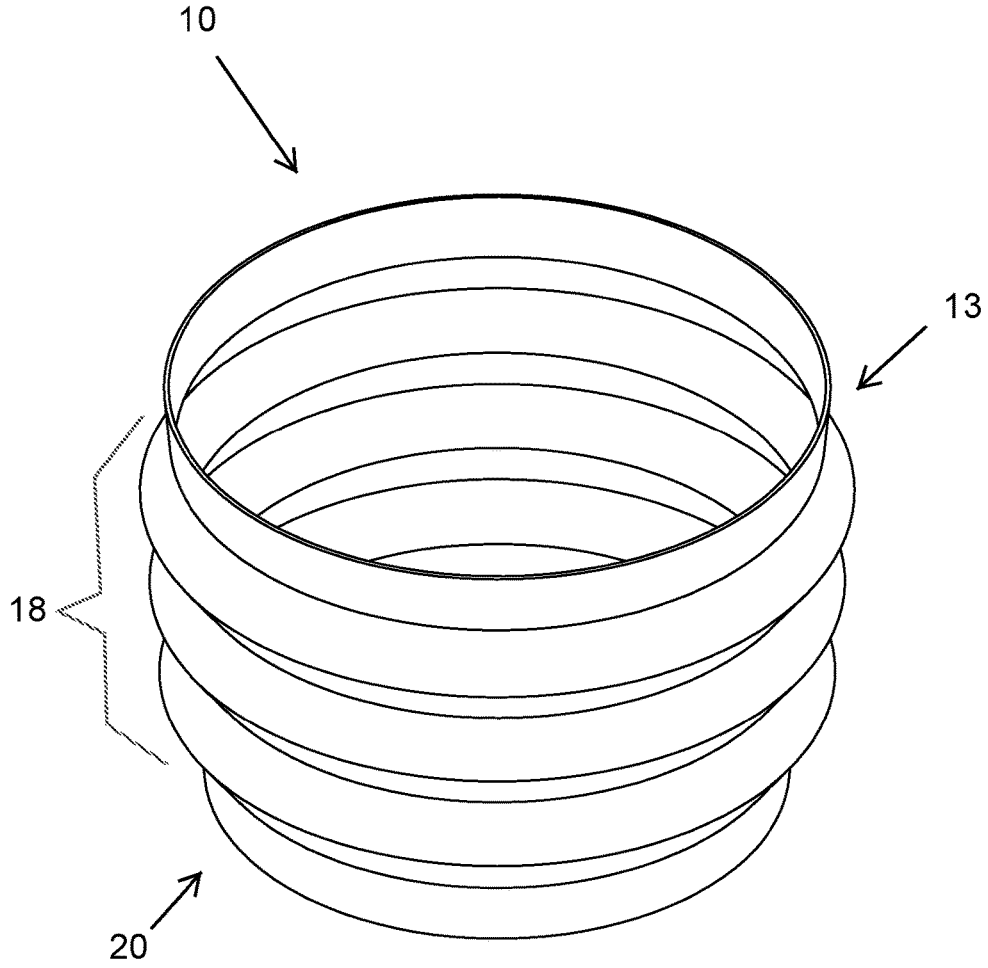
FIG. 4 is a perspective view of the insulating cup sleeve, shown in FIG. 3, compressed to a shortened state.
Figure 5:
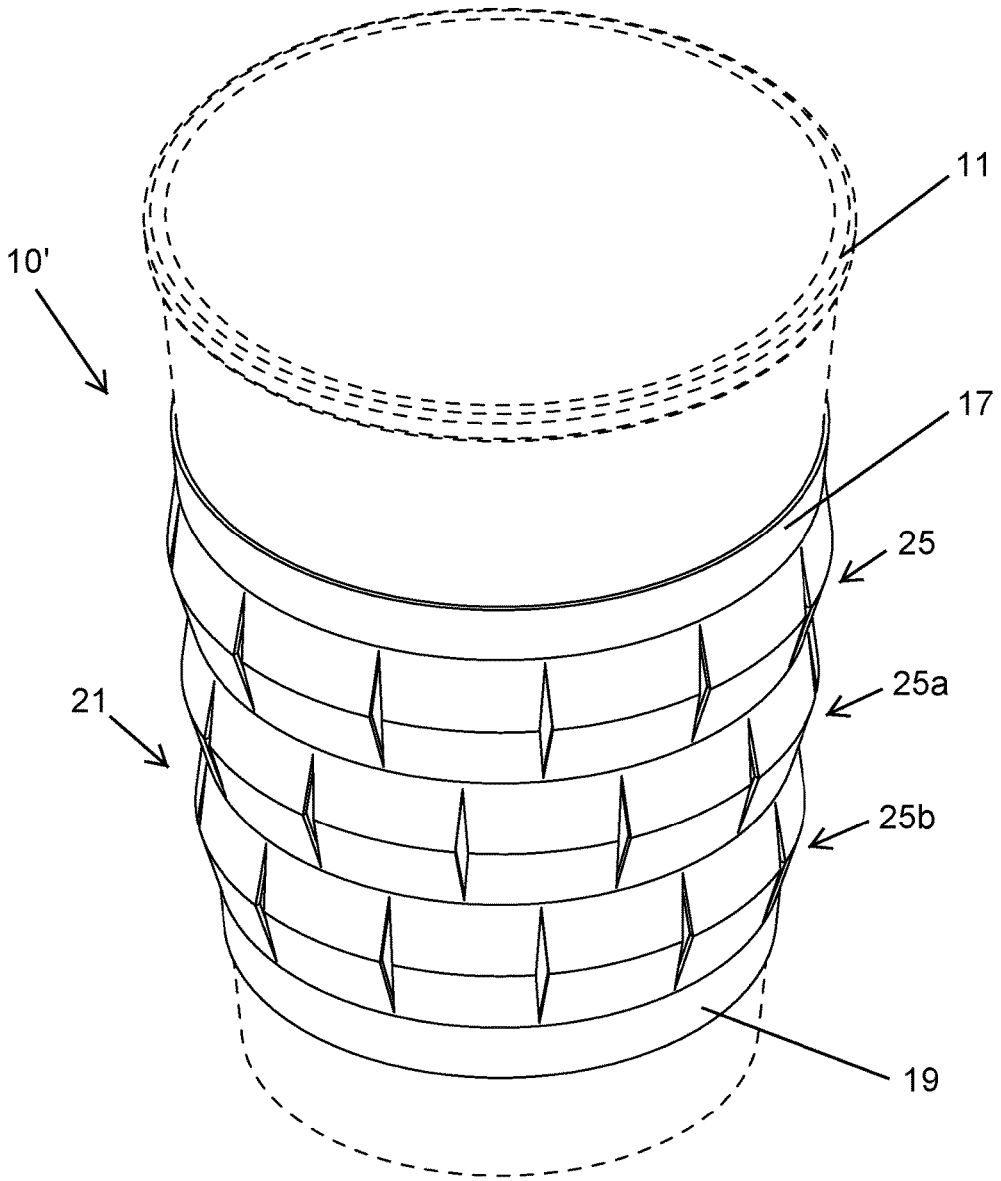
FIG. 5 is a perspective view of the insulating cup sleeve, shown in FIG. 1, positioned about an existing beverage container (cup)
Figure 6:
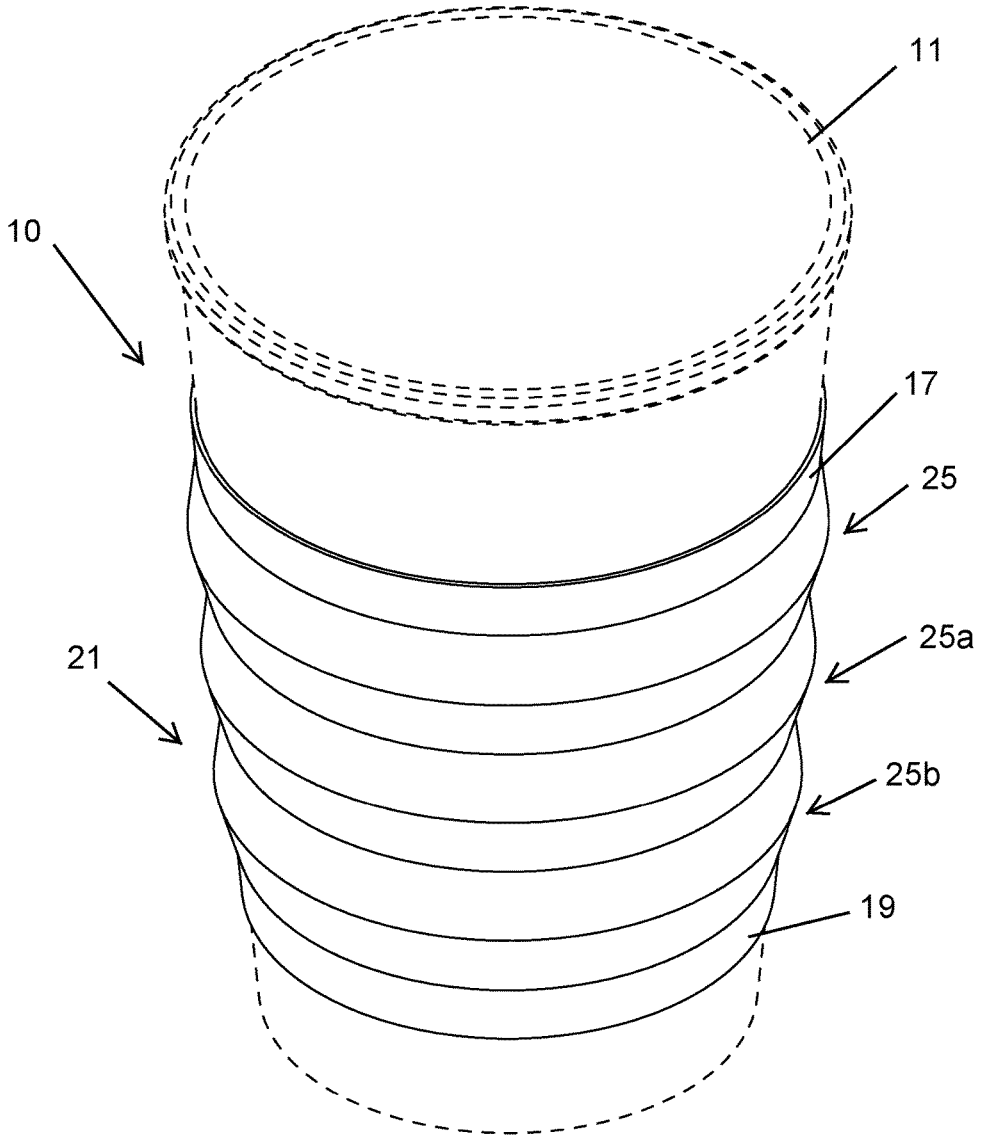
FIG. 6 is a perspective view of the insulating cup sleeve, shown in FIG. 3, positioned about an existing beverage container (cup)
Figure 7:
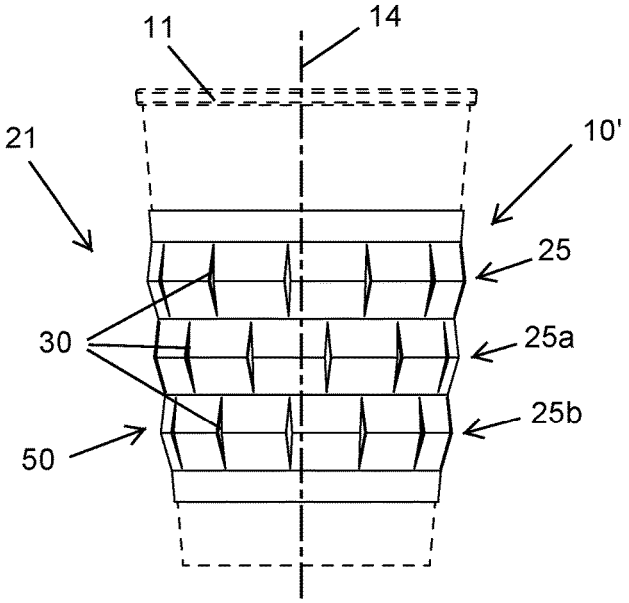
FIG. 7 is a side elevational view of the insulating cup sleeve, shown in FIG. 5, positioned about an existing beverage container (cup)
Figure 8:
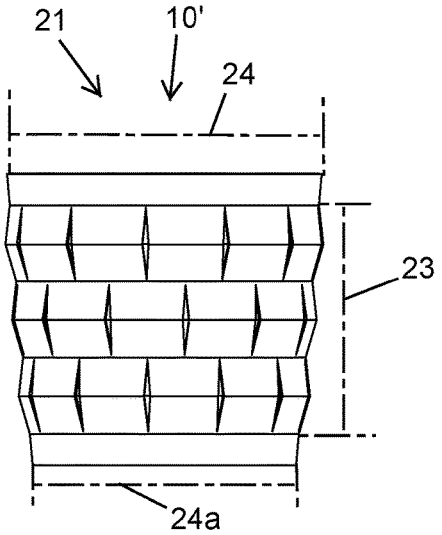
FIG. 8 is a side elevational view of the insulating cup sleeve, shown in FIG. 1, at the extended (elongated) state.
Figure 9:
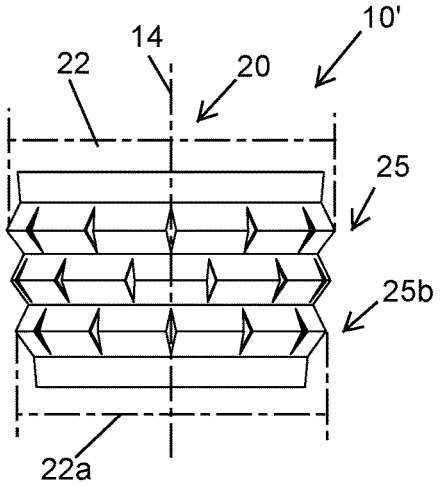
FIG. 9 is a side elevational view of the insulating cup sleeve, shown in FIG. 2, at the shortened state.
Figure 10:
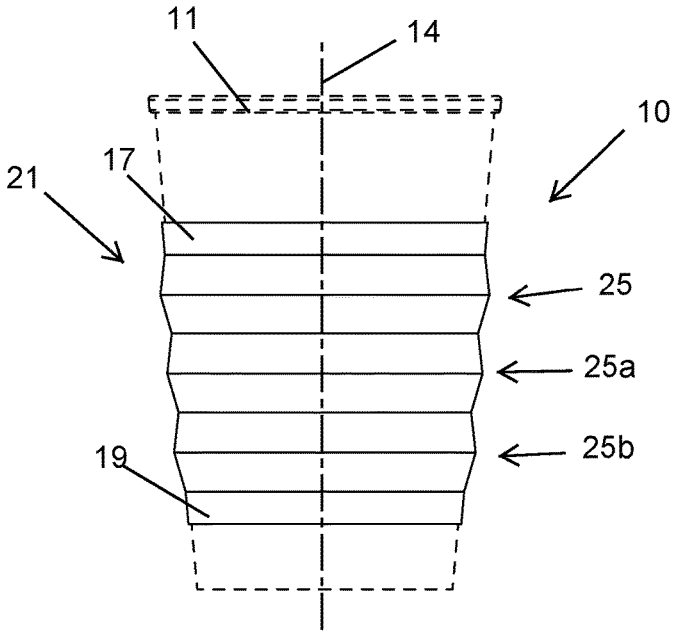
FIG. 10 is a side elevational view of the insulating cup sleeve, shown in FIG. 6, positioned about an existing beverage container (cup)
Figure 11:
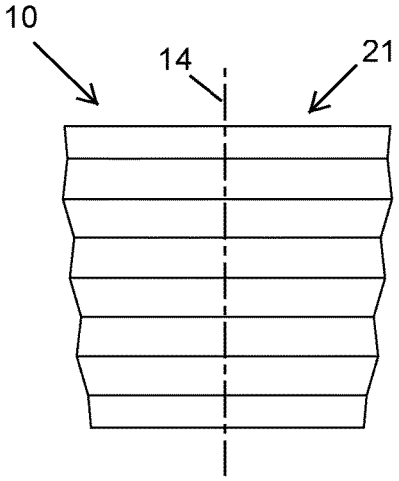
FIG. 11 is a side elevational view of the insulating cup sleeve, shown in FIG. 3, at the extended (elongated) state.
Figure 12:
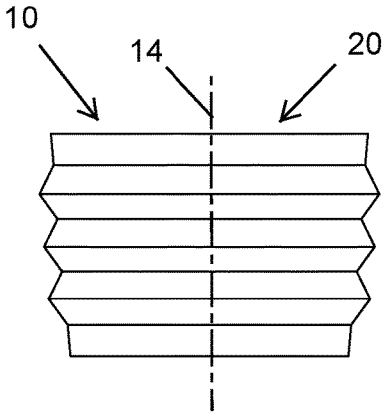
FIG. 12 is a side elevational view of the insulating cup sleeve, shown in FIG. 4, at the shortened state.
Figure 13:
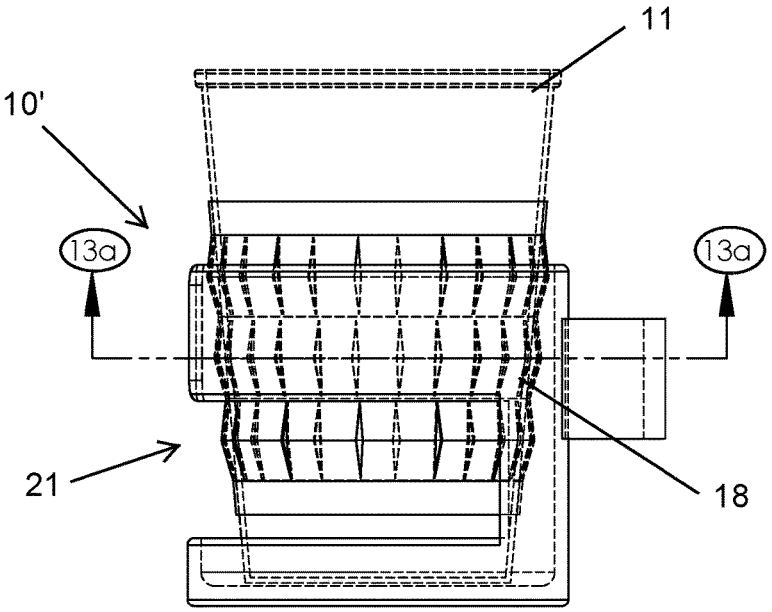
FIG. 13 is a side elevational view showing the combined beverage container and decompressed (unfolded) beverage container sleeve seated within and spaced from an interior surface of a cup holder.
Figure 13A:
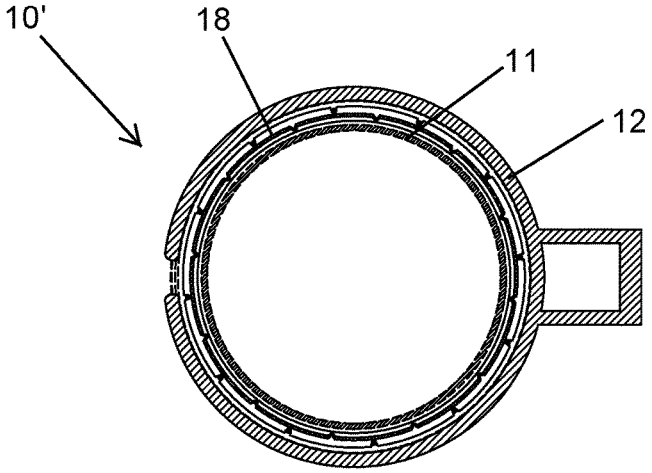
Figure 14:
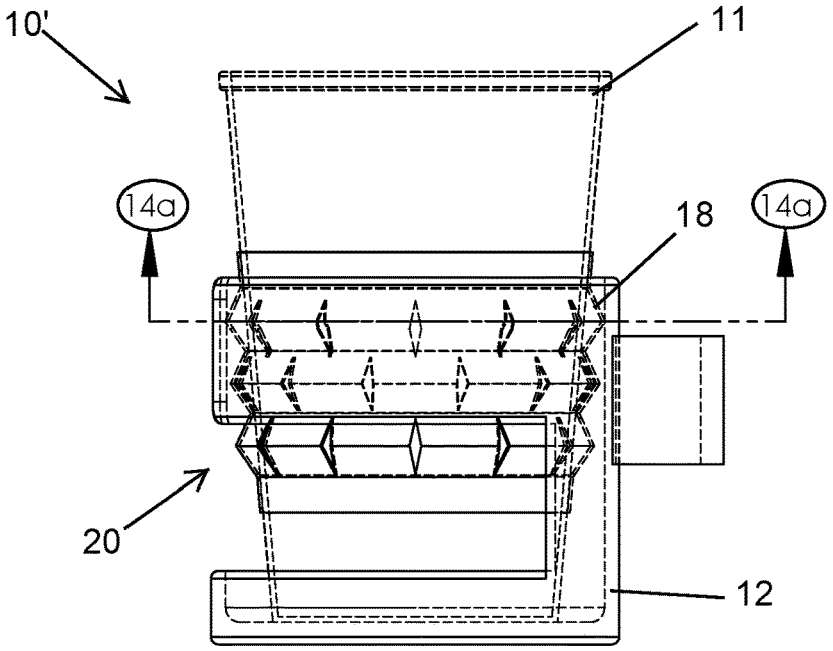
Figure 14A:
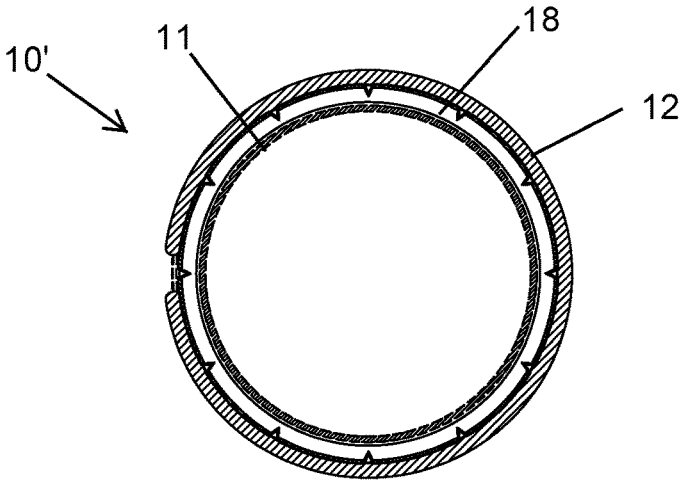

FIG. 13*a* is a cross-sectional view taken along line 13*a*-13*a* in FIG. 13;

FIG. 14 is a side elevational view showing the combined beverage container and compressed (folded) beverage container sleeve seated within and frictionally engaged with the interior surface of the cup holder; and FIG. 14*a* is a cross-sectional view taken along line 14*a*-14*a* in FIG. 14.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The terms "cup" and "beverage container" are interchangeably used throughout the present disclosure. A "cup holder" may include a vehicle cup holder or similar structure supported at either a fixed or mobile position. Of course, the "cup holder" is not restricted to vehicle cup holders. It is noted that the "beverage container" is removably positioned in the "cup holder."

The terms "extended," "elongated," "decompressed," "equilibrium," "unfolded," and the like are interchangeably used throughout the present disclosure.

The terms "retracted," "shortened," "compressed," "tensioned," "folded," and the like are interchangeably used throughout the present disclosure.

The non-limiting exemplary embodiment(s) is/are referred to generally in FIGS. 1-14*a* and is/are intended to provide an insulating cup sleeve 10, 10' (beverage container sleeve). The beverage container sleeve 10, 10' has an adjustable accordion configuration removably position about a beverage container 11 such that the accordion sleeve 10, 10' is selectively extended and retracted between elongated 21 (e.g., decompressed, unfolded) and shortened 20 (e.g., compressed, folded) states. The beverage container sleeve 10, 10' is intended to maintain an existing beverage container 11 within an existing cup holder 12 (beverage container holder). The beverage container sleeve 10, 10' can be selectively morphed between narrower/taller 21 and wider/shorter 20 states, to maintain frictional contact with various sized cup holders 12.

Such a beverage container sleeve 10, 10' includes a body 13 having an accordion configuration provided with a centrally registered longitudinal axis 14. The body 13 includes an exterior surface 15 and an interior surface 16 oppositely position therefrom wherein the interior surface 16 preferably includes a thermally insulative layer. The body 13 further includes an upper portion 17, a bellowed portion 18, and a lower portion 19. Advantageously, the bellowed portion 18 interconnects the upper portion 17 to the lower portion 19. In this manner, the bellowed portion 18 is configured to be selectively compressed and decompressed between folded and unfolded positions 20, 21, respectively, such that, when the bellowed portion 18 is compressed to the folded position 20, the bellowed portion 18 is outwardly displaced away from the centrally registered longitudinal axis 14 and thereby has a greater latitudinal width 22 and a shortened longitudinal length 23. Such a structural configuration facilitates frictional contact with an oversized cup holder 12 such that the beverage container 11 does not rattle or fall through the oversized cup holder 12.

In non-limiting exemplary embodiments 10, 10', each of the upper portion 17 and the lower portion 19 is open and has a static diameter 24, 24*a*, respectively.

In non-limiting exemplary embodiment 10, 10', the bellowed portion 18 is intercalated between the upper portion 17 and the lower portion 19. Advantageously, the bellowed portion 18 is flexible and configured to be selectively reciprocated (e.g., morphed) between an elongated position 21 and a shortened position 20.

In non-limiting exemplary embodiment 10, 10', a longitudinal length 23 of the bellowed portion 18 is greater at the elongated position 21 than the shortened position 20.

In non-limiting exemplary embodiments 10, 10', the bellowed portion 18 includes a plurality of flexible sections 25, 25*a*, 25*b* configured to be biased between a folded state 20 and an unfolded state 21 along a direction substantially parallel to the centrally registered longitudinal axis 14.

In a non-limiting exemplary embodiment 10', the bellowed portion 18 further includes a plurality of perforated cut-outs 30 (e.g., slits, apertures) extended along a longitudinal height of each flexible section 25, 25*a*, 25*b*. Such perforated cut-outs 30 are juxtaposed along a circumferential length 50 (e.g., outer border) of the flexible sections 25, 25*a*, 25*b*. Advantageously, each of the perforated cut-outs 30 is prohibited from traversing between adjacently positioned ones of the flexible sections 25, 25*a*, 25*b*. Such a structural configuration facilitates proper repeated compression and decompression between the folded state 20 and unfolded state 21.

In non-limiting exemplary embodiments 10, 10', a bottom-most one 25*b* of the flexible sections has a diameter (latitudinal width 22*a*) smaller than a diameter (latitudinal width 22) of a top-most one 25 of the flexible sections.

In non-limiting exemplary embodiments 10, 10', the flexible sections 25, 25*a*, 25*b* are contiguously connected in a stacked configuration.

The present disclosure further includes a method of utilizing a beverage container sleeve 10, 10' to secure an existing beverage container 11 within an existing cup holder 12 (beverage container holder). Such a method includes the steps of: providing an existing cup holder 12; providing an existing beverage container 11; and providing a beverage container sleeve 10, 10' including a body 13 having an accordion configuration provided with a centrally registered longitudinal axis 14. Such a body 13 includes an exterior surface 15 and an interior surface 16 oppositely position therefrom, wherein the interior surface 16 preferably includes a thermally insulative layer. The body 13 further includes an upper portion 17, a bellowed portion 18, and a lower portion 19. Advantageously, the bellowed portion 18 interconnects the upper portion 17 to the lower portion 19.

The method further includes the steps of: slidably positioning the beverage container sleeve 10, 10' about the existing beverage container 11; selectively compressing and decompressing the bellowed portion 18 of the beverage container sleeve 10, 10' between folded and unfolded positions 20, 21 wherein, when the bellowed portion 18 is compressed to the folded position 20, the bellowed portion 18 is outwardly displaced away from the centrally registered longitudinal axis 14 and thereby has a greater latitudinal width 22 and a shortened longitudinal length 23; and while the bellowed portion 18 is at the folded position 20, contemporaneously positioning the beverage container sleeve 10, 10' and the existing beverage container 11 within the existing cup holder 12 such that the bellowed portion 18 maintains frictional engagement with an interior surface 16 of the existing cup holder 12.

Referring to FIGS. 1-14*a* in general, the present disclosure provides an insulating cup sleeve 10, 10' configured to receive a variety of differently sized cups 11 (beverage containers) that contain beverages, and spans approximately more than one half of the surface area of the beverage container. During use, the beverage container 11 and beverage container sleeve 10, 10' can be securely positioned in various sized beverage container holders 12 (cup holders). The beverage container sleeve 10, 10' preferably includes an upper opening 47 and bottom opening 48 and an exterior surface 15 and interior surface 16, wherein the interior surface 16 may be composed of a thermally insulating material, such as neoprene polystyrene, polyurethane foam, cellulose, and/or mineral wool, configured to keep hot beverages inserted therein from losing their heat. The exterior surface 15 may be composed of a plastic, rubber, or paper material.

In one embodiment, the exterior surface 15 may comprise a tacky layer for providing an enhanced grip when carrying the cup 11 (beverage container).

In another embodiment, the exterior surface 15 is composed of the same material as the interior surface 16, such that the entire sleeve 10 is composed of one material.

As a non-limiting example, a user can insert the cup 11 into the upper opening 47 of the sleeve 10, 10' until the cup 11 extends through the bottom opening 48 of the sleeve 10, 10', thereby surrounding the majority of the cup 11.

There are shown various views of the beverage container sleeve 10, 10' in retracted 20 (compressed, folded) and extended 21 (decompressed, unfolded) configurations for accommodating wider and narrower cup holders 12. As noted above, the insulating cup sleeve 10, 10' may be defined by an upper portion 17, a bellowed portion 18, and a lower portion 19, wherein the bellowed portion 18 interconnects the upper and lower portion 19 to form the cup sleeve 10, 10'. The bellowed portion 18 can be composed of a flexible material which can be extended 21 or compressed 20, thereby enabling the cup sleeve 10, 10' to adjust in size (e.g., longitudinal length 23 and latitudinal width 22). The bellowed portion 18 comprises a plurality of accordion like bellows or folds and creases (e.g., collectively flexible sections 24, 24*a*, 24*b*) that enable the bellowed portion 18 to fold/compress and unfold/extend, linearly, such the upper portion 17 and lower portion 19 slide along the cup 11 relative to one another, when the bellowed portion 18 is compressed or extended.

In one embodiment 10', the bellowed portion 18 includes a plurality of perforated cut-outs 30 for facilitating displacement from the unfolded state 21 to the folded state 20. Such a configuration assists in maintaining the sleeve 10' at the folded state 20 at a substantially stable position when, for example, cardboard or similar material is employed to make the sleeve 10'. Of course, the sleeve 10' can be made from a variety of materials and is not limited to cardboard and the like.

When the bellowed portion 18 is folded/compressed, the cup sleeve 10, 10' is in the compressed configuration 20 and when the bellowed portion 18 is unfolded/extended, the cup sleeve 10' is in extended configuration 21. When the cup sleeve 10, 10' is in compressed configuration 20, the bellowed portion 18 projects outwardly thereby extending the latitudinal width 22 and decreasing the longitudinal length 23 of the cup sleeve 10, 10'. In this way, if a user inserts a smaller cup 11 into a vehicle's larger cup holder 12, the user can compress the cup sleeve 10, 10' such that the bellowed portion 18 contacts the interior walls of the larger cup holder 12 and prevents the smaller cup 11 from toppling over and spilling its contents. Then, once removed from the larger cup holder 12, the user can adjust the cup sleeve 10, 10' into its extended configuration, such that the cup sleeve 10, 10' is substantially straightened along the cup 11 and the user may grasp the cup sleeve 10, 10' and cup 11 regularly.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A method of utilizing a beverage container sleeve to maintain an existing beverage container within an existing, movable cup holder, said method comprising the steps of:

providing an existing, movable cup holder;

providing an existing beverage container;

providing a beverage container sleeve including a body having an accordion configuration provided with a centrally registered longitudinal axis, said body including an exterior surface and an interior surface oppositely position therefrom, said interior surface including a thermally insulative layer; an upper portion, a bellowed portion, and a lower portion, wherein said bellowed portion interconnects said upper portion to said lower portion;

slidably positioning said beverage container sleeve about the existing beverage container;

selectively compressing and decompressing said bellowed portion of said beverage container sleeve between folded and unfolded positions; wherein, when said bellowed portion is compressed to said folded position, said bellowed portion is outwardly displaced away from the centrally registered longitudinal axis and thereby has a greater latitudinal width and a shortened longitudinal length; and while said bellowed portion is at said folded position, contemporaneously positioning said beverage container sleeve and the existing beverage container within the existing, movable cup holder such that said bellowed portion maintains frictional engagement with an interior surface of the existing, movable cup holder;

wherein said bellowed portion includes a first bellow section, a second bellow section, and a third bellow section, said second bellow section being directly and continuously connected to each of said first bellow section and said third bellow section;

wherein each of said upper portion and said lower portion has a fixed diameter;

wherein said interior surface at each of said upper portion and said lower portion are smooth, planar and uninterrupted.

2. The method of claim 1, wherein said first bellow section is a single, top-most bellow section, wherein said second bellow section is a single, intermediate bellow section, wherein said third bellow section is a single, bottom-most bellow section.

3. The method of claim 2, wherein each of said first bellow section, said second bellow section, and said third bellow section is inwardly spaced from said interior surface of said existing, movable cup holder when said bellow portion is decompressed to said unfolded position.

4. The method of claim 3, wherein each of said first bellow section, said second bellow section, and said third bellow section is directly engaged with said interior surface of said existing, movable cup holder when said bellow portion is compressed to said folded position.

5. A method of utilizing a beverage container sleeve to maintain an existing beverage container within an existing, movable cup holder, said method comprising the steps of:

providing an existing, movable cup holder;

providing an existing beverage container;

providing a beverage container sleeve including a body having an accordion configuration provided with a centrally registered longitudinal axis, said body including an exterior surface and an interior surface oppositely position therefrom, said interior surface including a thermally insulative layer; an upper portion, a bellowed portion, and a lower portion, wherein said bellowed portion interconnects said upper portion to said lower portion;

slidably positioning said beverage container sleeve about the existing beverage container;

selectively compressing and decompressing said bellowed portion of said beverage container sleeve between folded and unfolded positions; wherein, when said bellowed portion is compressed to said folded position, said bellowed portion is outwardly displaced away from the centrally registered longitudinal axis and thereby has a greater latitudinal width and a shortened longitudinal length; and while said bellowed portion is at said folded position, contemporaneously positioning said beverage container sleeve and the existing beverage container within the existing, movable cup holder such that said bellowed portion maintains frictional engagement with an interior surface of the existing, movable cup holder;

wherein said bellowed portion includes a first bellow section, a second bellow section, and a third bellow section, said second bellow section being directly and continuously connected to each of said first bellow section and said third bellow section;

wherein each of said upper portion and said lower portion has a fixed diameter;

wherein said interior surface at each of said upper portion and said lower portion are smooth, planar and uninterrupted;

wherein said top portion has an outermost edge substantially coplanar with said exterior surface of said body when said bellow portion is at the unfolded position;

wherein said outermost edge has an outermost diameter substantially equal to a maximum diameter of said exterior surface of said body when said bellow portion is at the unfolded position;

wherein said outermost diameter of said outermost edge is less than a diameter of said interior surface of said existing, movable cup holder;

wherein said top portion of said beverage container sleeve neither extends over nor covers a top opening of said existing, movable cup holder;

wherein said lower portion has a bottom opening such that a continuous and uninterrupted path exists between said upper portion and said bottom opening.

* * * * *